US010875033B2

(12) United States Patent
Janson et al.

(10) Patent No.: US 10,875,033 B2
(45) Date of Patent: Dec. 29, 2020

(54) REMOVAL OF FERROMAGNETIC MATERIAL FROM A FLUID STREAM

(71) Applicant: ConocoPhillips Company, Houston, TX (US)

(72) Inventors: Arnold Janson, Doha (QA); Samer Adham, Doha (QA); Joel Minier-Matar, Doha (QA); Altaf Hussain, Doha (QA); Eman Alshamari, Doha (QA); Nabin Upadhyay, Doha (QA); Dareen Zuhir Omar Dardor, Doha (QA)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 16/208,635

(22) Filed: Dec. 4, 2018

(65) Prior Publication Data

US 2019/0176164 A1 Jun. 13, 2019

Related U.S. Application Data

(60) Provisional application No. 62/595,784, filed on Dec. 7, 2017.

(51) Int. Cl.
*B03C 1/033* (2006.01)
*B03C 1/28* (2006.01)

(52) U.S. Cl.
CPC ..... *B03C 1/0332* (2013.01); *B03C 1/284* (2013.01); *B03C 1/286* (2013.01); *B03C 1/288* (2013.01);

(Continued)

(58) Field of Classification Search
CPC ..... B03C 1/286; B03C 2201/18; B03C 1/00; B03C 1/0332; B03C 1/284;

(Continued)

(56) References Cited

U.S. PATENT DOCUMENTS 5,055,190 A * 10/1991 Hayes ..... B03C 1/025 209/224
5,575,919 A * 11/1996 Santina ..... C02F 1/5245 210/695

(Continued)

FOREIGN PATENT DOCUMENTS

GB 762163 A 11/1956

*Primary Examiner* — Claire A Norris
(74) *Attorney, Agent, or Firm* — Conocophillips Company

(57) ABSTRACT

A magnetic filter assembly 1 is described which is suitable for incorporating into a fluid system such that a process fluid flows through the filter to remove ferromagnetic particles in the fluid. The filter assembly 1 comprises a housing 2 having a flow chamber. The housing also comprises one or more elongate hollow sleeves 10 extending into the flow chamber such that, in use, an exterior surface of each sleeve 10 is exposed to the process flow and an interior surface of each sleeve 10 is sealed from the process flow. Each sleeve 10 has an opening via which the interior surface of the sleeve is open or openable to the environment whilst remaining sealed from the process flow. Each sleeve has received in it a magnet 12, the magnet being removable from the sleeve via the opening. In this way, cleaning of the filter by removal of the magnets is facilitated, without exposing the process flow.

10 Claims, 5 Drawing Sheets

(52) U.S. Cl.
CPC ..... *B03C 2201/18* (2013.01); *B03C 2201/28* (2013.01)

(58) Field of Classification Search
CPC ... B03C 2201/28; B03C 2201/20; C02F 1/48; C02F 2201/48
USPC ..... 210/695, 222; 96/1; 209/223.1, 214, 224
See application file for complete search history.

(56) References Cited

U.S. PATENT DOCUMENTS

| | | | | |
|---|---|---|---|---|
| 6,833,069 | B1 | 12/2004 | Asterlin | |
| 8,900,449 | B2 | 12/2014 | Lin et al. | |
| 9,352,331 | B1 * | 5/2016 | Lee | B03C 1/034 |

* cited by examiner

REMOVAL OF FERROMAGNETIC MATERIAL FROM A FLUID STREAM

CROSS-REFERENCE TO RELATED APPLICATIONS

This application is a non-provisional application which claims benefit under 35 USC § 119(e) to U.S. Provisional Application Ser. No. 62/595,784 filed Dec. 7, 2017, entitled "REMOVAL OF FERROMAGNETIC MATERIAL FROM A FLUID STREAM," which is incorporated herein in its entirety.

FIELD OF THE INVENTION

This invention relates to processes and apparatus for removing ferromagnetic material from a fluid stream.

BACKGROUND OF THE INVENTION

It is possible for fluid streams of many kinds to become contaminated with ferromagnetic material such particles of iron or iron oxides. It is sometimes possible to remove this material by means of an applied magnetic field. Apparatus for this purpose is known, for example, in the food industry and in the automotive industry. Commonly, particles of iron or iron oxide from pipework may become entrained in a fluid flow passing through the pipework. A substantial proportion of this type of ferromagnetic material may be separated from the fluid steam by a permanent magnet or an electromagnet suitably positioned with respect to the pipework. Normally a cleaning or flushing operation is required periodically to remove accumulated ferromagnetic material.

Previous solutions have tended to suffer from one or more issues which make them unsuitable for certain high flow applications, for example as encountered in the oil and gas industry. For example, many prior solutions involve having the magnetic component directly exposed to the fluid which can mean that removing accumulated ferromagnetic material is difficult. This can make cleaning complex and potentially inadequate. Mechanical wipers or scrapers are sometimes used, but this adds cost and complexity and the cleaning is not always adequate. Furthermore, in these types of filters the fluid to be treated, or at least the interior of the pipework or other apparatus through which it normally flows, needs to be exposed in order to clean the device; this may be hazardous to personnel or may result in contamination of the fluid or pipework.

Other solutions involve having the magnetic component arranged on the outside of pipework or on the outside of a filter housing enclosing the flow. This may address the problem of removal of accumulated ferromagnetic particles since the magnetic field can be removed or switched off. However, in this arrangement the magnetic field may be applied inefficiently to the flow, with much or even the majority of the field extending away from pipeline and not interacting with the fluid flow to be treated. This is not only inefficient, therefore requiring large magnets, but may also be a hazard to personnel or other equipment, e.g. electronic equipment, in the vicinity. Shielding may be required, with associated cost and bulk. Solutions of this type tend to be heavy and bulky.

Even with the possibility of the magnetic field being disabled in some way, e.g. by removal of a permanent magnet or switching off an electromagnet, magnetic particles may remain adhered to a surface which has been directly exposed to the process fluid and upon which they have accumulated due to an applied magnetic field. Desirably, some additional method of cleaning this surface would be provided without opening the process fluid or interior of the pipework or other apparatus to the environment.

Some known filters have a magnet external to a filter housing and temporarily magnetizable elements made e.g. from soft iron located within the housing. This has the advantage of having a magnetized element in direct contact with the fluid which can provide for a strong field/fluid interaction, but has the problem that such elements can become permanently magnetized to a degree which can make cleaning difficult even when the external magnet is removed or switched off.

U.S. Pat. No. 8,900,449 discusses a magnetic filter comprising a filter housing installed in pipework. The housing has a cover which may be opened thereby exposing the interior of the filter and pipework to the environment. After opening the cover, a number of rod-shaped magnetic elements may be removed from sleeves which extend into a filter chamber. The sleeves may also be removed, or the entire assembly of magnetic rods and sleeves together with a supporting frame.

GB762,163 describes a magnetic filter comprising an annular filter housing having corrugated soft iron pole pieces within its annular flow path. External to the housing and located in the center of the annulus is a permanent magnet whose magnetic field is channeled by the pole pieces so that flow is exposed directly to magnetized components. When cleaning is required, the permanent magnet is withdrawn. In addition, the flow of process fluid is stopped and a flushing operation performed using a separate inlet and outlet.

BRIEF SUMMARY OF THE DISCLOSURE

The invention more particularly includes a magnetic filter assembly suitable for incorporating into a fluid system such that a process fluid flows through the magnetic filter, the filter assembly comprising: a filter housing having a flow chamber which, in use, is exposed to the process fluid; the filter housing comprising one or more elongate hollow sleeves extending into the flow chamber such that, in use, an exterior surface of each sleeve is exposed to the process flow and an interior surface of each sleeve is sealed from the process flow; wherein each sleeve has an opening at a proximal end thereof via which the interior surface of each sleeve is open or openable to the environment whilst remaining sealed from the process flow; each sleeve has received in it a magnet, the magnet being removable from the sleeve via the opening.

The invention also includes a method of filtering ferromagnetic material from a process fluid, the method comprising: connecting a filter assembly as described above to a process fluid circuit and causing the process fluid to flow through the filter assembly; and periodically cleaning the filter assembly by removing the magnets from the sleeves without exposing the interior of the process fluid circuit to the surroundings.

The invention also includes a method of filtering ferromagnetic material from a process fluid, the method comprising: connecting a filter assembly as described above to a process fluid circuit and causing the process fluid to flow through the filter assembly; and periodically cleaning the filter assembly by deactivating the electromagnets without exposing the interior of the process fluid circuit to the surroundings, and optionally also removing the electromagnets.

BRIEF DESCRIPTION OF THE DRAWINGS

A more complete understanding of the present invention and benefits thereof may be acquired by referring to the following description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1B:
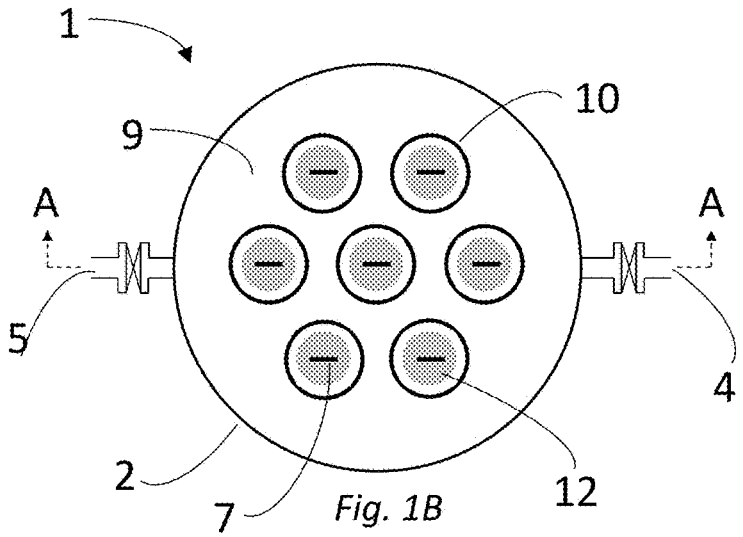
FIG. 1B is a schematic plan view from above of a filter unit according to the invention.
Figure 1A:
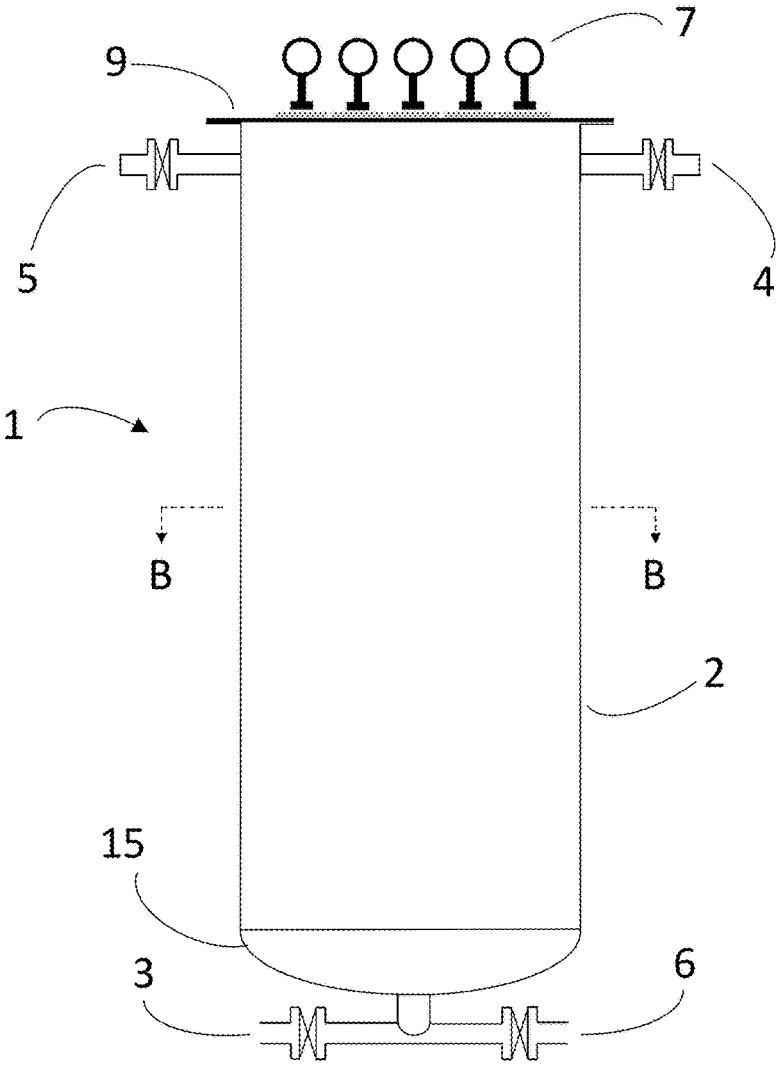
FIG. 1A is a schematic elevation of a filter unit according to the invention.

Referring firstly to FIG. 1A, a magnetic filter 1 comprises a filter housing 2 of generally cylindrical shape. The cylinder is arranged with its axis vertical. At the bottom is an end cap 15 through which is a conduit which connects via respective valves to a feed inlet 3 and a drain 6.

In the sides of the cylinder 2 at its upper end are a product outlet 4 (for filtered process fluid) and a backwash inlet 5, both with respective valves. The top of the cylinder is sealed with a top plate 9 (or "tubesheet"). Sleeves of thin plastics material pass through and are sealed around apertures in the top plate 9; the sleeves extending down into the filter chamber defined within the housing 2, almost for the full length of the housing 2.

In the plan view FIG. 1B, the top plate 9 and seven sleeves 10 can be seen. Received within each sleeve is a magnet rod 12 comprised of a strong permanent magnet made for example of an alloy of neodymium, iron and boron (though any suitable material may be used). Each magnet rod 12 has a handle 7 at the top which can be used to withdraw the rods individually.

Figure 2B:
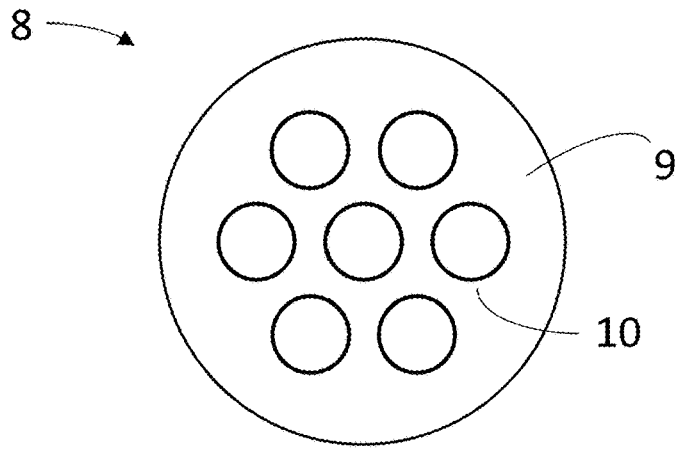
FIG. 2B is a schematic plan view of a sleeve insert assembly of a filter unit according to the invention.
Figure 2A:
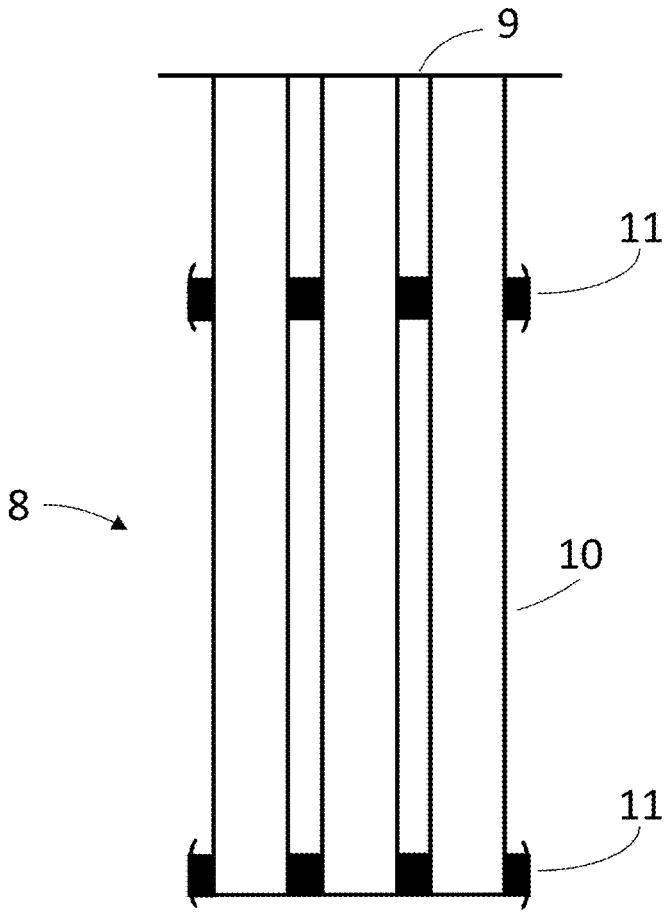
FIG. 2A is a schematic elevation of a sleeve insert assembly of a filter unit according to the invention.

The top plate 9 may be separated from the cylinder by means of releasable fastenings (not shown) and replaced again, re-making the seal. As seen in FIGS. 2A and 2B, the sleeves 10 are permanently attached to the top plate 9 to form a sleeve assembly 8 which may be removed as one unit when the top plate fastenings are released. In the sleeve assembly 8, the sleeves 10 are supported at the lower end by a guide member 11 which maintains the spacing amongst the sleeves 10 and also between the housing 2 and the sleeves 10. The sleeve assembly may be removed either with the magnet rods 12 within the sleeves 9 or after removal of the magnet rods.

Figure 3:
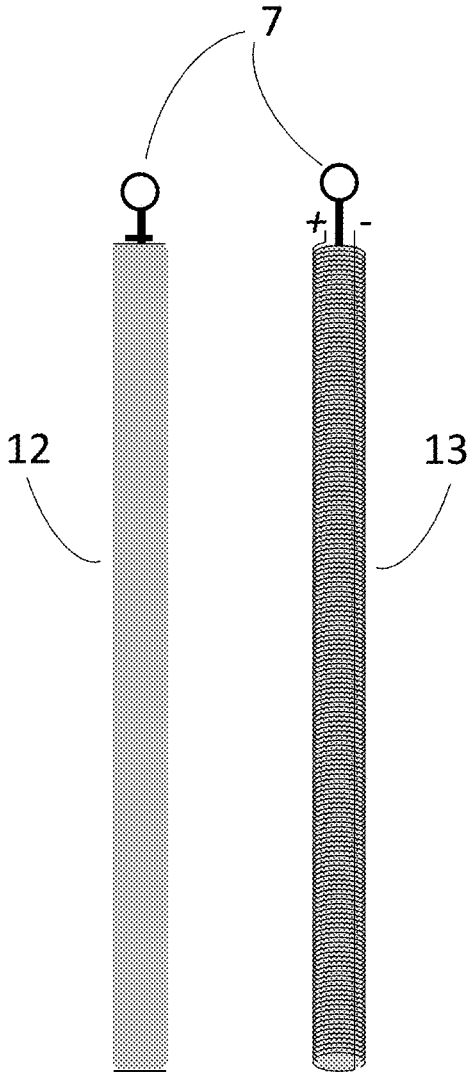
FIG. 3 is a schematic view of alternative magnetic rod elements from a filter unit according to the invention.

In a modified embodiment (not shown in the figures) the magnet rods comprise a number, e.g. five, individual magnets which may be spaced longitudinally e.g. using spacers made of some non-magnetic material such as a plastics material. The individual magnets could be loose and installed simply by sliding into the sleeves, alternating with spacer elements. Alternatively, the magnets and spacer elements could be part of a magnet assembly which retains the magnets and spacers relative to each other, allowing simpler insertion of the magnets into a sleeve. The reasons for this are explained below Alternatively, the permanent magnet rods 12 could be replaced by electromagnets 12. See FIG. 3. The electromagnet rods 13 are in most respects the same as the permanent magnet rods 12 except that a soft iron core (or similar), winding and electrical supply is required. In a modification, each rod could be made up from a number of electromagnets spaced apart by non-magnetic material, as described above.

Figure 4B:
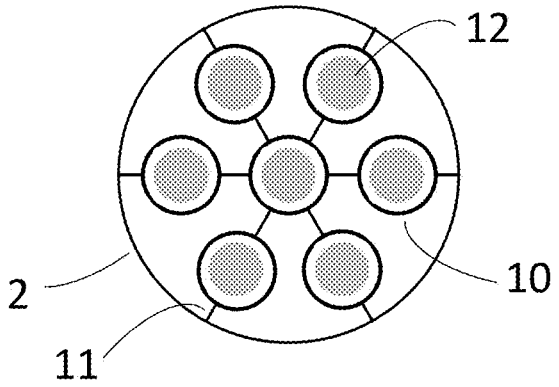
FIG. 4B is a sectional view taken on the line B-B in FIG. 1A.
Figure 4A:
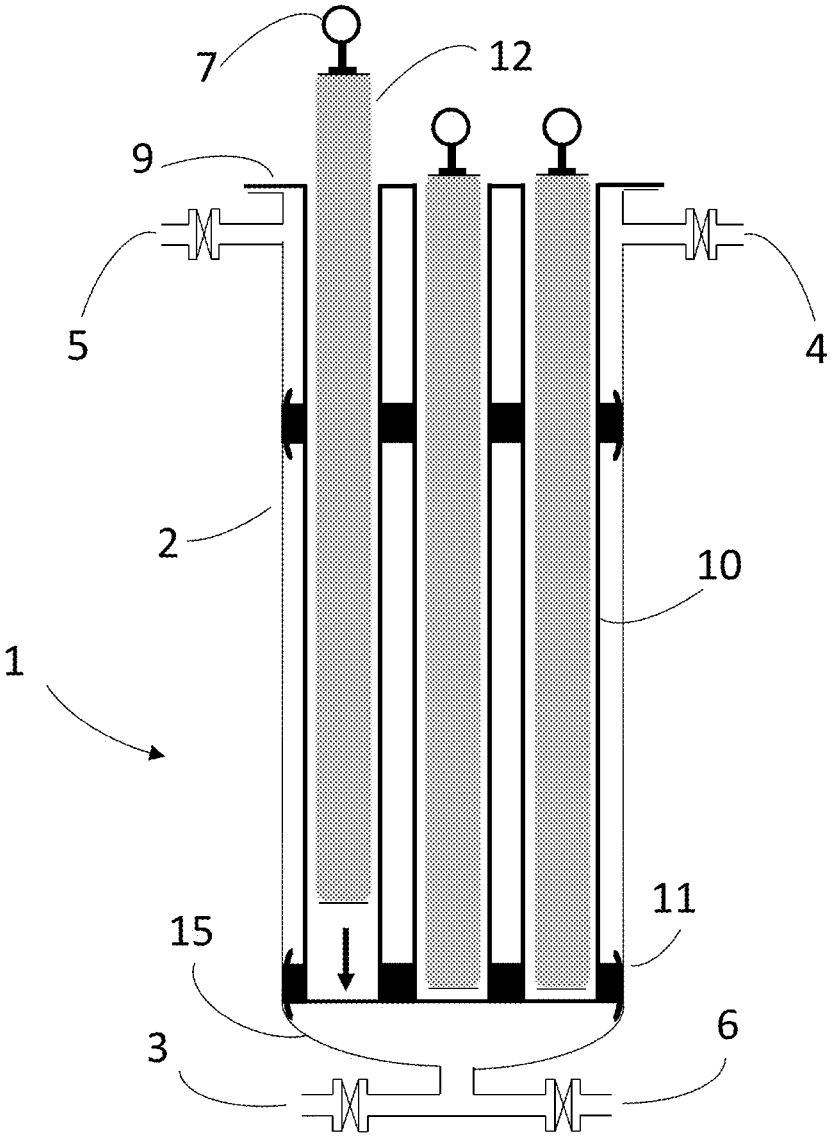
FIG. 4A is a sectional view taken on the line A-A in FIG. 1B.

In FIG. 4A, which is a sectional view, the sleeve assembly 10 can be seen in place within the filter housing 2. One magnet rod 12 is shown being inserted into its sleeve. Upper and lower guide members 11 are shown. FIG. 4B shows a plan sectional view showing the magnet rods 12 in place in the sleeves 10 and also showing the guide members 11 which space the sleeves from each other and from the housing 2.

Figure 5B:
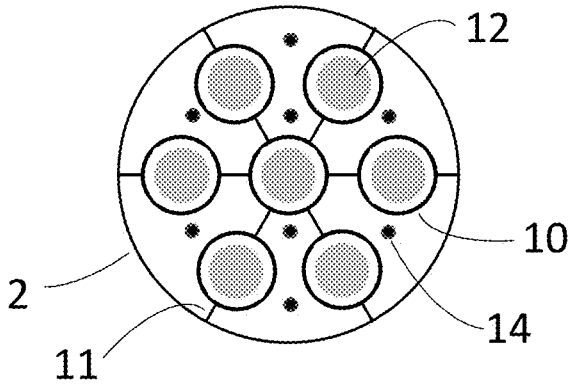
FIG. 5B is a sectional view, similar to FIG. 4B, of a second embodiment of the invention which incorporates aerators.
Figure 5A:
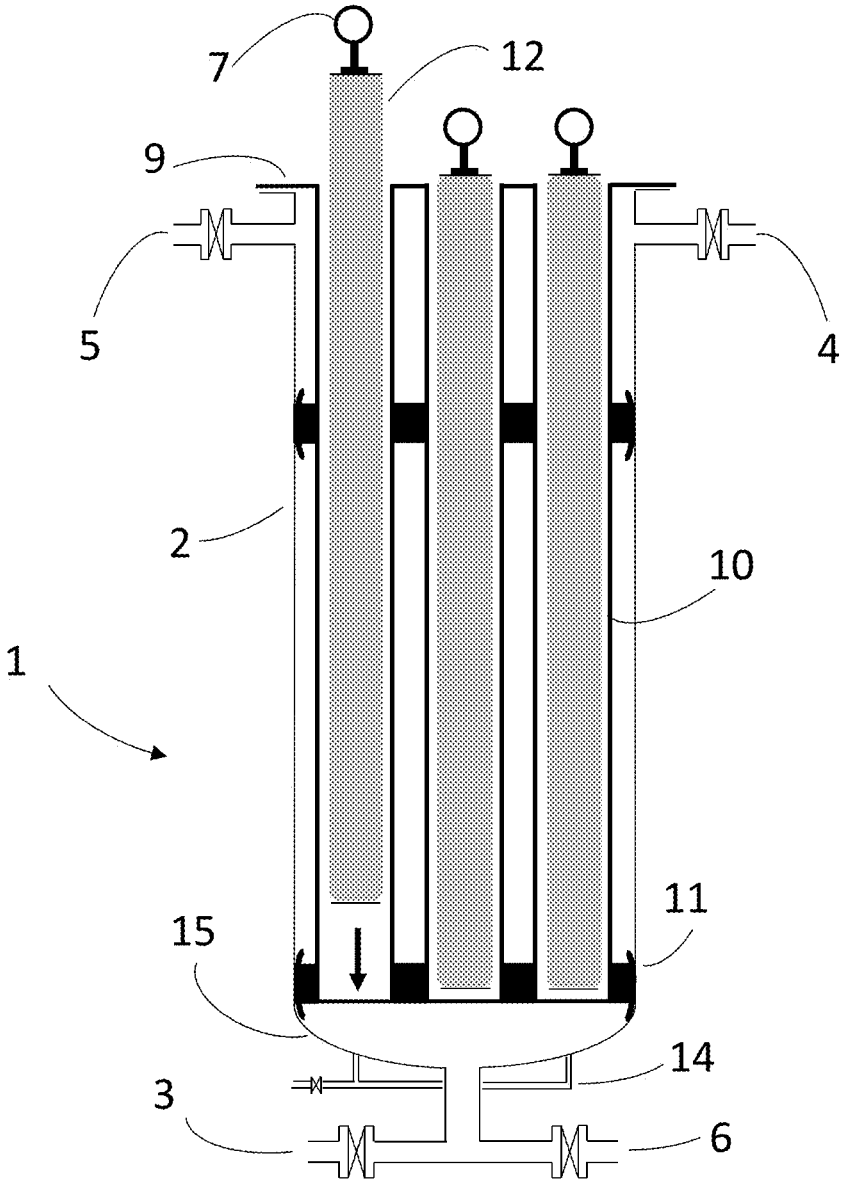
FIG. 5A is a sectional view, similar to FIG. 4A, of a second embodiment of the invention which incorporates aerators.

FIGS. 5A and 5B show a second embodiment which is the same as that described above except that gas inlets 14 are provided in the lower end cap 15. The second embodiment is shown with permanent magnet rods 12, but the alternative magnet types and configurations described above apply equally to this embodiment.

In a modification of either embodiment, the magnetic filter unit 1 may be oriented such that the axis of the cylindrical housing 2 is horizontal or at some angle between vertical and horizontal. Gas inlets can be provided along vessel's lower surface. The reasons for this are explained below.

An individual filter can be sized for fluid flowrates typically ranging from 10 to 200 $m^3/h$. Since the units are modular, multiple units can be provided in parallel to provide on-line spare capacity or to achieve higher flowrates. The magnets generally range in diameter from 2 cm to 10 cm although larger diameter magnets can be used, especially when electromagnets are used. The neodymium magnets are typically provided with a non-corrosive coating containing any of a variety of materials including nickel, copper, zinc, epoxy or rubber. The sleeve into which the magnets are inserted would generally be between 30 cm and 200 cm in length and typically 2-6 mm larger in diameter than the outside diameter of the magnets. For applications with permanent magnets, a series of smaller length magnets would be used held together end-to-end by their own magnetic attraction forces. The selection of the magnet material must consider the temperature of the process fluid, generally from 1° C. up to 200° C. for neodymium/iron/boron magnet alloys. For temperature applications up to 860° C., other magnetic alloys must be used. The vessel & sleeve material of construction should be non-magnetic, corrosion resistant and suitable for the operating temperatures expected. One example material would be reinforced polyester resin, also called fiberglass reinforced plastic.

Example 1

Returning to the first embodiment shown in FIGS. 1 to 4, the magnetic filter unit 1 is connected into a closed loop cooling water system in a natural gas liquefaction plant (not shown in the drawings). The filter unit 1 is oriented horizontally, i.e. with the axis of the cylinder horizontal. The end cap 15, which is shown at the bottom of the filter unit 1 in FIG. 1A, is to one side in this arrangement, and the top plate 9 at the other side of the unit is oriented vertically.

In a further modified embodiment, when the unit is oriented horizontally, the end cap 15 could be replaced by a second tubesheet. The magnet sleeves can then run the full length of the housing and be supported at each end. Magnets may be inserted or removed at either or both ends of the sleeves. If desired, each magnet element can be only half the length of a sleeve and each sleeve can hold two magnets which are inserted and removed at respective ends of the sleeve. In this event the feed inlet 3 and drain 6 would be provided in the side wall of the housing 2.

Because it is a closed loop and ferromagnetic solid production rates are low, the filter is installed such that only a small portion, typically 0.5-10% of the total flow is processed. This also significantly reduces cost. A sidestream of the contaminated cooling water supply is connected to the filter unit via the feed inlet 3 in the end cap 15 and product outlet 4 is connected back into the cooling water circuit, so that cleaned cooling water is returned to the circuit. The backwash inlet 5 is connected to a source of clean fresh water and the drain outlet 6 to a suitable location for disposal.

Contaminated cooling water flows through the filter unit and ferromagnetic material is deposited on the sleeves 10. All or most of the ferromagnetic material in the cooling water stream is removed so that clean water flows from the product outlet 4. The ferromagnetic material is a mixture of metallic iron particles, iron compounds such as oxides and also organic compounds which may have reacted with iron or iron oxides from the pipework.

In practice, the cooling water flow will vary significantly with the application. In petrochemical applications, an example flow would be 10,000 $m^3$/h. A design that targets filtering 5% of the flow would need to process 500 $m^3$/hr and would require 3 or 4 vessels, each about 1 m in diameter, 1 m long with 0.2 m diameter inlet and outlet connections, very reasonable for this application and the expected solids loadings. The residence time of the water in the filter would be 10 to 15 seconds. Particle removal efficiency would depend on site conditions including particle size, temperature, and the strength of the magnets used.

Some of the iron compounds are soluble. A chemical additive, e.g. hydrogen peroxide, is introduced to the cooling water stream and the stream heated; this results in solid ferromagnetic particles precipitating out of solution. This process is carried out immediately upstream of the filter unit 1 and the ferromagnetic precipitate is then captured by the filter 1. At this stage the inventors have not explored in detail the chemistry of causing soluble iron compounds to form ferromagnetic precipitates, but they believe that it may be possible to achieve this effect without heating.

Once the filter has been running for typically 10-180 days, it is desirable to clean accumulated magnetic material from the sleeves 10 in the filter unit 1. The valves on the feed inlet 3 and the product outlet 4 are shut and the filter is isolated from service. The filter can be either bypassed or the sidestream flow can be directed through a parallel circuit to another filter. The magnet rods 12 are then manually removed from the sleeves 10 using the handles 7. When the magnets are small and lightweight, a horizontal orientation of the filter unit 1 makes this operation more straightforward than if the unit had been arranged vertically. In modified embodiments, the removal of the rods 12 could be automated or a mechanical aid can be provided to assist with carrying the weight of the magnets. In the alternative embodiment with electromagnets, the magnets may simply be switched off to remove the magnetic field. However, even if electromagnets are used, it may still be desirable to remove the magnets completely in case of residual magnetism in the electromagnets.

The valves 5 and 6 are then opened and fresh water is passed through the unit to remove accumulated magnetic material, which may be freed from the sleeves because it is no longer subject to a magnetic field. Surfactants or other chemicals can be added to the flush water to aid in the removal of the accumulated ferromagnetic materials.

In a modified embodiment, the influent flow of liquid during flushing is temporarily suspended and gas (e.g. nitrogen) is bubbled or sparged through the gas inlets 14. The gas bubbles will serve to create turbulence and thereby aid in the removal the accumulated ferromagnetic material from the sleeves (see FIG. 5). Nitrogen is the preferred gas for sparging because if its inert-ness and relatively low cost.

Sparging may have the effect of reducing the amount of flush water required, thus saving water. Depending on the number of filter vessels in parallel in an installation and the amount of accumulated material, it may be practical to reuse the spent flushing water from one filter unit in the cleaning of successive units.

Example 2

In this example, all details are the same except that the filter feed 3 is connected to a flow of hydrocarbon liquid, e.g. crude oil, liquefied natural gas or some other fraction of crude oil and the product outlet 4 is connected back into the same process flow. In this example, the liquid used for flushing may be the feed, an organic solvent or a detergent solution in place of fresh water.

In either example, periodic maintenance of the magnetic rods may be required and this is easily done by removing one or more rods at a time whilst continuing to operate the filter with the remaining rods in place, or alternatively substituting replacement rods whilst the original rods are serviced.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. U.S. Pat. No. 8,900,449
2. GB762,163.

The invention claimed is:

1. A method of filtering ferromagnetic material from a process fluid, the method comprising:

a. providing a process fluid circuit, the circuit incorporating a magnetic filter assembly;

b. the magnetic filter assembly comprising:

i. a filter housing having a flow chamber which, in use, is exposed to the process fluid;

ii. the filter housing comprising one or more elongate hollow sleeves extending into the flow chamber such that, in use, an exterior surface of each sleeve is exposed to the process fluid and an interior surface of each sleeve is sealed from the process fluid; wherein iii. each sleeve has an opening at a proximal end thereof via which the interior surface of each sleeve is open or openable to the environment whilst remaining sealed from the process fluid;

iv. each sleeve has received in it a magnet, the magnet being removable from the sleeve via the opening;

c. causing the process fluid to flow through the filter assembly;

d. periodically cleaning the filter assembly by removing the magnets from the sleeves without exposing the interior of the process fluid circuit to the surroundings;

e. after the magnets have been removed, flushing cleaning liquid through the filter assembly to remove accumulated ferromagnetic material;

f. temporarily suspending influent flow of cleaning liquid; sparging gas through the filter assembly to create turbulence and thereby aid in the removal of accumulated ferromagnetic material.

2. A method as claimed in claim 1, wherein the sparging gas is nitrogen gas.

3. A method as claimed in claim 1 further comprising injecting a chemical into the process fluid circuit upstream of the filter assembly which chemical reacts with one or more dissolved contaminant compounds in the process fluid to produce one or more ferromagnetic precipitates.

4. A method as claimed in claim 3 wherein the injected chemical is hydrogen peroxide and the process further comprises heating the process fluid upstream of the filter assembly.

5. A method as claimed in claim 1 wherein the filter assembly is connected into a side stream of a main process fluid circuit.

6. A method of filtering ferromagnetic material from a process fluid, the method comprising:

a. providing a process fluid circuit, the circuit incorporating a magnetic filter assembly;

b. the magnetic filter assembly comprising:

i. a filter housing having a flow chamber which, in use, is exposed to the process fluid;

ii. the filter housing comprising one or more elongate hollow sleeves extending into the flow chamber such that, in use, an exterior surface of each sleeve is exposed to the process fluid and an interior surface of each sleeve is sealed from the process fluid; wherein iii. each sleeve has an opening at a proximal end thereof via which the interior surface of each sleeve is open or openable to the environment whilst remaining sealed from the process fluid;

iv. each sleeve has received in it an electromagnet;

c. causing the process fluid to flow through the filter assembly;

d. periodically cleaning the filter assembly by deactivating the electromagnets without exposing the interior of the process fluid circuit to the surroundings;

f. after the magnets have been deactivated, flushing cleaning liquid through the filter assembly to remove accumulated ferromagnetic material;

g. temporarily suspending influent flow of cleaning liquid; sparging gas through the filter assembly to create turbulence and thereby aid in the removal of accumulated ferromagnetic material.

7. A method as claimed in claim 6, wherein the sparging gas is nitrogen gas.

8. A method as claimed in claim 6 further comprising injecting a chemical into the process fluid circuit upstream of the filter assembly which chemical reacts with one or more dissolved contaminant compounds in the process fluid to produce one or more ferromagnetic precipitates.

9. A method as claimed in claim 8 wherein the injected chemical is hydrogen peroxide and the process further comprises heating the process fluid upstream of the filter assembly.

10. A method as claimed in claim 6 wherein the filter assembly is connected into a side stream of a main process fluid circuit.

* * * * *